US012648602B2

(12) United States Patent
Falk et al.

(10) Patent No.: US 12,648,602 B2
(45) Date of Patent: Jun. 9, 2026

(54) WETSUIT WITH A REAR MIDPORTION OPENING

(71) Applicant: Noora Ocean AB, Kullavik (SE)

(72) Inventors: Nicklas Falk, Kullavik (SE); Karin Lissbrant Falk, Kullavik (SE)

(73) Assignee: NOORA OCEAN AB, Kullavik (SE)

( * ) Notice: Subject to any disclaimer, the term of this patent is extended or adjusted under 35 U.S.C. 154(b) by 0 days.

(21) Appl. No.: 19/081,601

(22) Filed: Mar. 17, 2025

(65) Prior Publication Data

US 2025/0295185 A1 Sep. 25, 2025

(30) Foreign Application Priority Data

Mar. 20, 2024 (SE) ..... 2450310-4

(51) Int. Cl.
*A41D 13/012* (2006.01)
*A41D 31/10* (2019.01)

(52) U.S. Cl.
CPC ..... *A41D 13/012* (2013.01); *A41D 31/10* (2019.02); *A41D 2300/322* (2013.01); *A41D 2400/44* (2013.01)

(58) Field of Classification Search
CPC .... A41D 13/012; A41D 13/129; A41D 31/06; A41D 31/10; A41D 2300/322; A41D 2400/44; A41D 2600/00; A41D 2600/106; A44B 19/00–19/64; A41H 37/06; D10B 2501/063; A41B 2400/44
USPC ..... 2/2.17, 69
See application file for complete search history.

(56) References Cited

U.S. PATENT DOCUMENTS 2,228,624 A * 1/1941 Leopold ..... A41D 1/06 2/235
2,321,926 A * 6/1943 Marinsky ..... A44B 19/32 24/387
2,671,257 A * 3/1954 Shur ..... A44B 19/267 24/400

(Continued)

FOREIGN PATENT DOCUMENTS

DE 2018759 A1 * 11/1970 ..... A44B 19/02
FR 3050362 A1 * 10/2017 ..... A41D 1/08

(Continued)

OTHER PUBLICATIONS

"Chloroprene Rubber (CR)." Lavelle. Nov. 21, 2015. https://www.lavelle.com/materials/chloroprene-rubber-cr (Year: 2015).*

(Continued)

*Primary Examiner* — Grace Huang
(74) *Attorney, Agent, or Firm* — Westman, Champlin & Koehler, P.A.

(57) ABSTRACT

The present relates to a wetsuit, comprising an upper body portion, a lower leg portion, and a mid-portion arranged between the upper body portion and the lower leg portion, the lower leg portion comprising a first leg and a second leg, wherein the first leg, the second leg and the mid-portion each comprises a front side and a rear side, wherein the wetsuit comprises a zipper configured to unzip at least a portion of the rear side of the mid portion, the zipper extending from an upper position of the first leg's front side to an upper position of the second leg's front side, via the rear side of the mid-portion.

9 Claims, 5 Drawing Sheets

(56) References Cited

U.S. PATENT DOCUMENTS

| | | | | |
|---|---|---|---|---|
| 2,849,717 | A | 9/1958 | Klotz | |
| 2,998,011 | A * | 8/1961 | Rubin | A41C 1/003 450/104 |
| 3,289,264 | A * | 12/1966 | Doelter | A44B 19/32 24/389 |
| 4,580,321 | A * | 4/1986 | Tanikawa | A44B 19/32 24/384 |
| 5,014,356 | A * | 5/1991 | Tomasi-Dubois | A41D 13/02 2/79 |
| 6,219,841 | B1 * | 4/2001 | Anderson | B63C 11/04 2/2.17 |
| 6,223,349 | B1 * | 5/2001 | Roiser | A44B 19/32 2/82 |
| 6,363,531 | B1 * | 4/2002 | Quinn | A44B 19/32 2/82 |
| 6,567,989 | B1 * | 5/2003 | Martinez | A41D 13/00 2/211 |
| 6,976,293 | B2 * | 12/2005 | Traulle | A44B 19/36 24/435 |
| 7,096,506 | B2 * | 8/2006 | Ragot | A41D 13/012 2/2.15 |
| 8,127,370 | B2 * | 3/2012 | Nunn | A41D 1/08 24/387 |
| 8,479,320 | B2 * | 7/2013 | Swafford | A41D 1/065 2/78.2 |
| 8,667,652 | B2 * | 3/2014 | Thomas | A44B 19/32 24/389 |
| 8,898,813 | B2 * | 12/2014 | Davis | A41D 13/02 2/79 |
| 9,119,428 | B2 * | 9/2015 | Kuelker | A41D 13/02 |
| 9,237,781 | B2 * | 1/2016 | Shimono | A41H 37/003 |
| 9,247,774 | B2 * | 2/2016 | Davis | A41D 13/02 |
| 10,093,401 | B2 * | 10/2018 | Myerscough | A41D 13/012 |
| 10,696,364 | B2 | 6/2020 | Harringdon et al. | |
| 10,765,156 | B2 | 9/2020 | Myerscough et al. | |
| 11,266,215 | B2 * | 3/2022 | Larson | A44B 19/32 |
| 11,382,367 | B2 | 7/2022 | Myerscough et al. | |
| 2007/0245529 | A1 * | 10/2007 | Stewart | A44B 19/388 24/415 |
| 2008/0040837 | A1 * | 2/2008 | King | A41D 27/00 112/475.16 |
| 2009/0100557 | A1 | 4/2009 | Insulan | |
| 2012/0073028 | A1 * | 3/2012 | Knopik | A41D 31/18 2/79 |
| 2012/0222190 | A1 * | 9/2012 | Lambertz | A41D 27/06 2/69 |
| 2014/0304894 | A1 * | 10/2014 | Bishop | A41D 1/06 2/236 |
| 2018/0222559 | A1 * | 8/2018 | Beyeler | A41D 31/102 |
| 2021/0137177 | A1 * | 5/2021 | Sun | A41D 27/24 |
| 2022/0354187 | A1 * | 11/2022 | McClure | A41D 1/04 |
| 2024/0349825 | A1 * | 10/2024 | Monier | A41D 13/02 |

FOREIGN PATENT DOCUMENTS

| | | | |
|---|---|---|---|
| JP | 2001-032106 | 2/2001 | |
| JP | 2001-032106 X | 2/2001 | |
| WO | 2007/027135 | 3/2007 | |
| WO | WO-2014204435 A1 * | 12/2014 | A41D 1/08 |

OTHER PUBLICATIONS

"Weld." Merriam-Webster. https://www.merriam-webster.com/dictionary/weld (Year: 2025).*

The Extended European Search Report from EP 25163614.8, dated Sep. 9, 2025.

Swedish Search Report from SE Application No. 2450310-4, dated Oct. 2, 2024.

* cited by examiner

WETSUIT WITH A REAR MIDPORTION OPENING

CROSS-REFERENCE TO RELATED APPLICATION

This application claims priority to Swedish Patent Application No. 2450310-4, filed Mar. 20, 2024, the content of which is hereby incorporated by reference in its entirety.

TECHNICAL FIELD

This invention relates to a wetsuit. In particular, the wetsuit is intended for women with the inclusion of a zipper to form an opening in the rear mid-portion. The zipper, when opened, allows users to go to the toilet anywhere to perform their natural needs without undressing an upper body part of the wetsuit or removing a life vest, harness or other garments on the upper body. This opening serves as a complement to openings for on/off dressing of the wetsuit.

BACKGROUND

There are many wetsuits available today that have openings for easy on and off dressing. However, and in particular for female users, a drawback of these wetsuits is that the entire wetsuit needs to be removed from the body when the user, for example, needs to go to the toilet.

There is thus a desire to simplify the task of undressing from the wetsuit, which may be particularly critical when additionally wearing a life vest over the wetsuit, such as when being on a sailing boat or similar craft.

SUMMARY OF THE INVENTION

According to an aspect of the invention, there is provided a wetsuit, comprising an upper body portion, a lower leg portion, and a mid-portion arranged between the upper body portion and the lower leg portion, the lower leg portion comprising a first leg and a second leg, wherein the first leg, the second leg and the mid-portion each comprises a front side and a rear side, wherein the wetsuit comprises a zipper configured to unzip at least a portion of the rear side of the mid portion, the zipper extending from an upper position of the first leg's front side to an upper position of the second leg's front side, via the rear side of the mid-portion.

A wetsuit is preferably constructed from tight-fitting neoprene to ensure its intended purposes of keeping the user warm and shield against weather elements. The warmth is generated by a thin insulating layer of water between the user's skin and the suit to retain body heat. A wetsuit cannot be made from loose-fitting fabrics like other suits to generate warmth from the users body, and therefore requires any opening at the rear mid-portion of the suit to maintain the intended structure and functionality of a wetsuit.

A technical benefit of the invention is that when opened, the rear mid-portion opening falls back, opening the back of the wetsuit and allowing the user to go and perform their natural needs anywhere without undressing the upper part of the wetsuit or other garments on the upper body as a life vest or harness, Furthermore, the user will not need to expose the torso. The rear mid-portion can thus be construed as a lid that falls back when unzipping the zipper.

The wetsuit may preferably be a watersport wetsuit. A watersport wetsuit may require a close-fitting suit made of material (such as e.g. neoprene) that is worn especially in connection to, or in, cold water to retain body heat by trapping a thin layer of water against the body. The suit should provide the user with freedom of movement and be designed in a manner that does not hinder the user from engaging in their activity. The watersport wetsuit may be a sailing wetsuit made for use when sailing. The watersport wetsuit may also be used for surfing activities, i.e. a surf wetsuit.

According to an example, the zipper extends in a forward lying C-shape. The lying C-shape may thus be construed as a C which is rotated substantially 90 degrees.

Enabling the zipper to fold around the body without impacting the form or the fit of the wetsuit is paramount to upkeep its intended functionality. Furthermore, the shape of the zipper allows a zipper lock to move easily around the body from its start position to its end position without the risk to be exposed to wear and tear, while at the same time providing structural support for the opening.

According to an example, the wetsuit further comprises a strip of neoprene attached to the lower leg portion and to the mid-portion, the zipper being arranged in the strip of neoprene as a unit for mounting the zipper to the wetsuit. The strip of neoprene is thus a strip of neoprene material.

The stresses, when forming the zipper in a C-shape, is substantially equally distributed to the neoprene strip ensuring a lasting form of the zipper without tendence to bend, wrinkle or fold. Any tendency to bend, wrinkle or fold would degrade the function of the zipper and potentially cause malfunctions.

According to an example, the strip of neoprene is at least welded to the lower leg portion and to the mid-portion.

When mounted in the wetsuit's structure, the neoprene strip panel works as a stress absorber between the zipper and interconnecting panels, providing a flexible and dynamic structure ensuring strength and endurance in seams between the panels. In addition, or as alternatives, to welding, the strip of neoprene may be glued, stitched and/or attached in other suitable manners to the lower leg portion and to the mid-portion.

According to an example, the zipper is attached to a respective inner surface of the upper position of the first leg's front side, the upper position of the second leg's front side, and the rear side of the mid-portion.

Allowing the zipper to be mounted into the wetsuit with a curved structure, while at the same time protecting the fastening fabric, the fastening fabric and the zipper itself is protected from degrading through wear and tear from the outside.

According to an example, the zipper comprises a zipper attachment structure attaching the zipper to the respective inner surfaces of the upper position of the first leg's front side, the upper position of the second leg's front side, and the rear side of the mid-portion.

According to an example, the zipper attachment structure comprises a plurality of recesses along the extension of the zipper from the upper position of the first leg's front side to the upper position of the second leg's front side.

The invention allows the zipper to be curved in the shape needed to provide the rear mid-portion opening without the tendency to bend, wrinkle or fold, while at the same time decrease stress in the zipper and mounting strip panel. Furthermore, it provides flexibility when the wetsuit neoprene is twisted or bend through usage.

The zipper preferably features an inner protective layer made of thin neoprene, which is divided into two parts. This layer protects against excessive water intrusion to maintain the wetsuit's functionality while preventing the user from being scratched or snagged by the zipper.

According to an example, the wetsuit is made of a neoprene material.

The neoprene material provides heat preservation, wind and weather protection, and buoyancy. The neoprene material may thus be particularly suitable for the conditions at sea.

According to an example, the wetsuit is a one-piece wet suit.

Wetsuits worn in cold climate zones during winter, autumn, and spring require thick fabric insulation, close-to-body fit without air pockets, and full body coverage, which is why one-piece wetsuits are predominantly preferred.

In view of the above description, the invention is a one-piece wetsuit that comes with a rear mid-portion opening on the back. The opening, which can also be referred to as a drop-seat opening enables users to perform their natural needs anywhere without undressing the upper body or taking off other gear they might wear.

The zipper stretches from the front upper part of one leg, over the hip and horizontally across the back, then over the other hip and down to the front upper part side of the other leg.

The zipper is preferably curved and embedded in the wetsuit's neoprene and seals the opening when closed, whereby waterproofing is maintained. When the zipper is opened, the rear mid-portion opens up and the fabric bends down in a natural position below the user's lower back in the form of a lid.

DETAILED DESCRIPTION OF THE INVENTION

Figure 1:
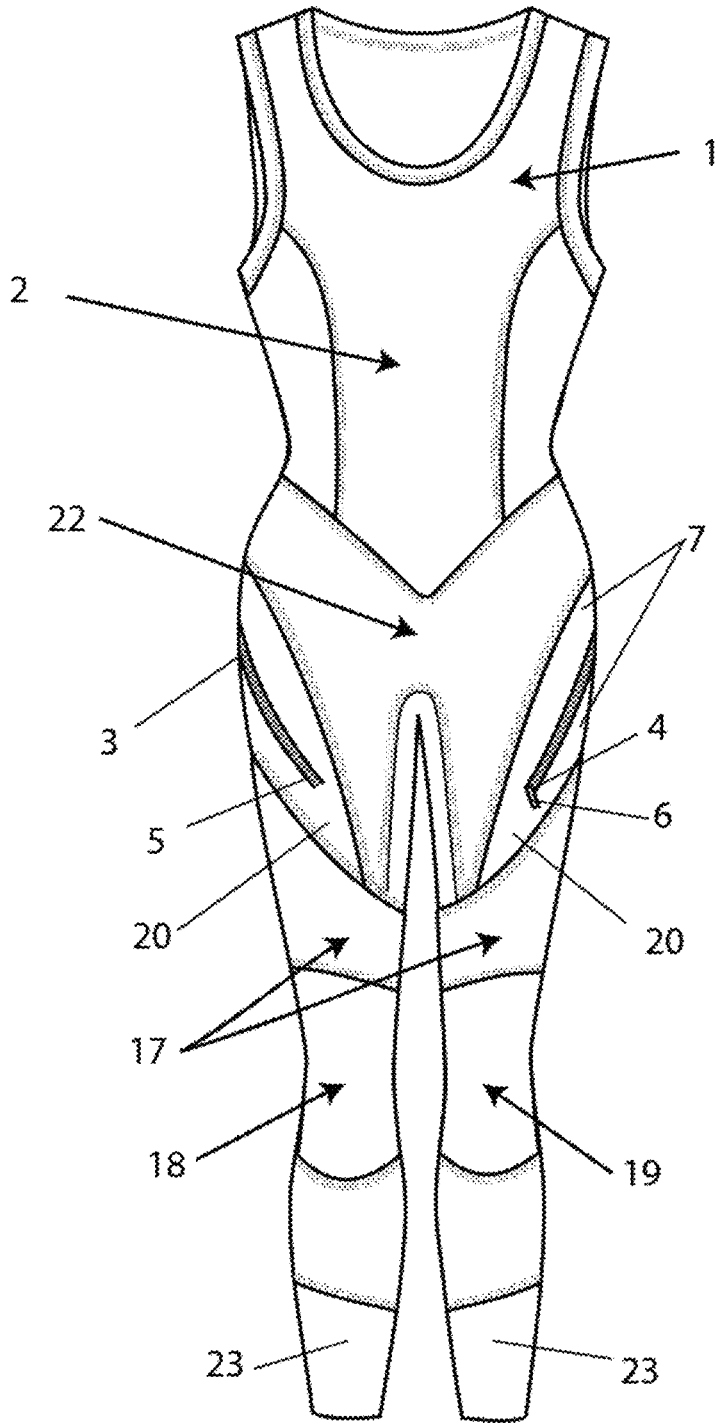
FIG. 1 is a front view of a wetsuit according to an example.
Figure 2:
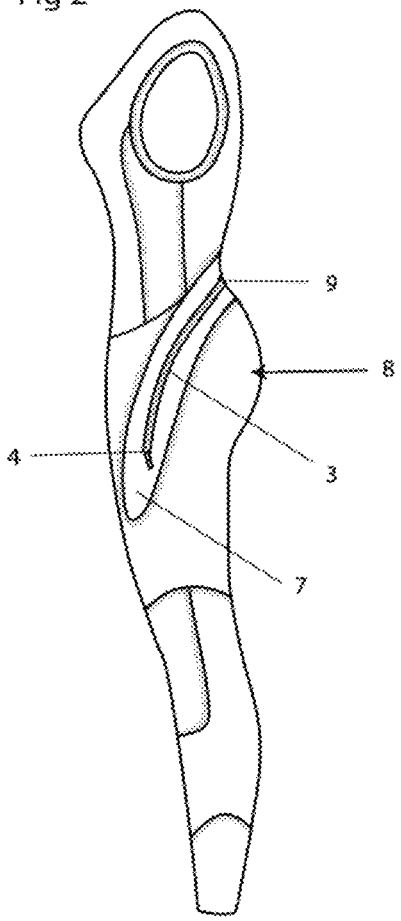
FIG. 2 is a side view of the wetsuit with the zipper closed according to an example.
Figure 3:
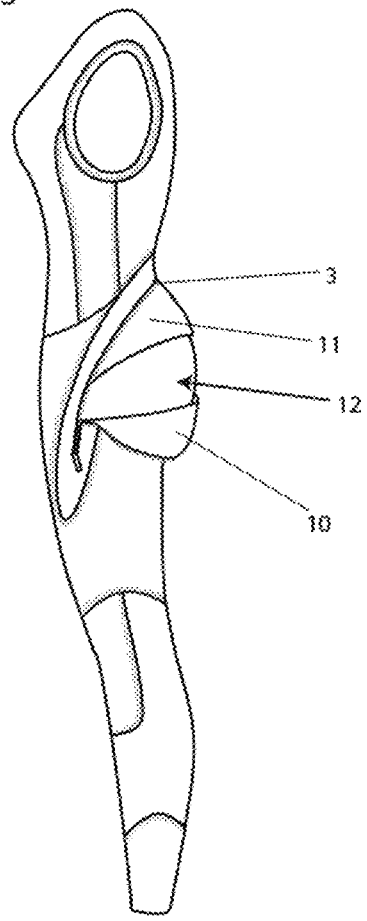
FIG. 3 is a side view of the wetsuit with the zipper open according to an example.
Figure 4:
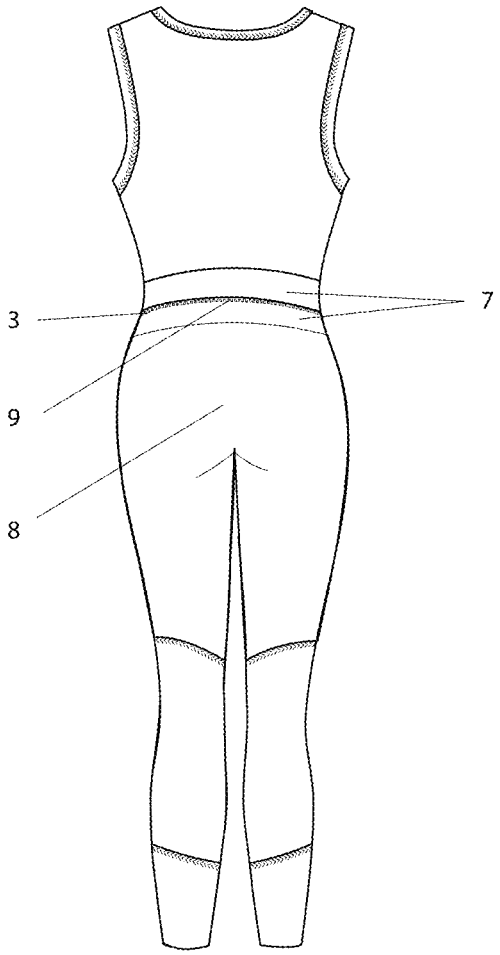
FIG. 4 is a rear view of the wetsuit with the zipper closed according to an example.
Figure 5:
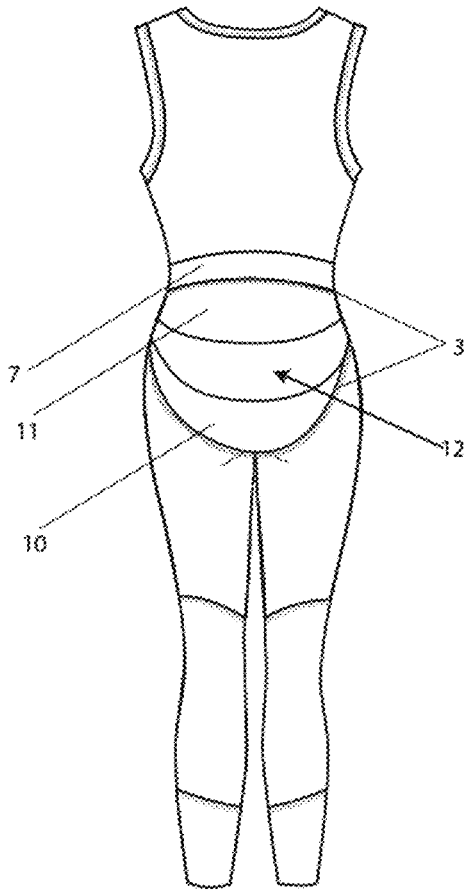
FIG. 5 is a rear view of the wetsuit with the zipper open according to an example.
Figure 6:
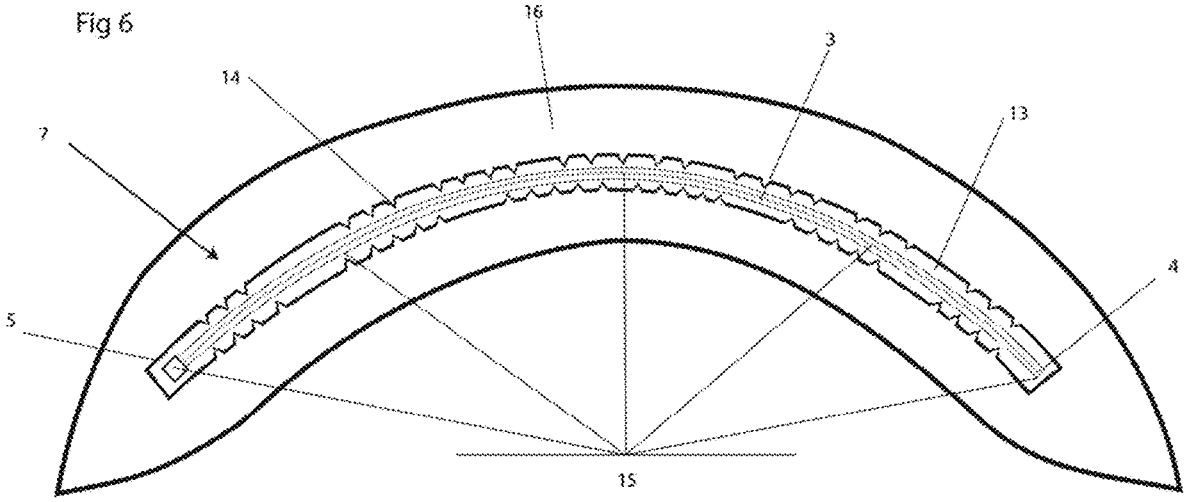
FIG. 6 is an illustration of the zipper attached to an inner surface according to an example.

Reference is made to FIGS. 1-6, where the wetsuit 1 and parts thereof is depicted in different manners according to examples. As can be seen, there is provided a wetsuit 1, comprising an upper body portion 2, a lower leg portion 17, and a mid-portion 8 arranged between the upper body portion and the lower leg portion, the lower leg portion comprising a first leg 18 and a second leg 19, wherein the first leg, the second leg and the mid-portion each comprises a front side 22 and a rear side, wherein the wetsuit comprises a zipper 3 configured to unzip at least a portion of the rear side of the mid portion, the zipper extending from an upper position 20 of the first leg's front side to an upper position of the second leg's front side, via the rear side of the mid-portion. The first leg 18 thus comprises an upper position 20 as well as a lower position 23. The lower position 23 is arranged in the vicinity of an opening for the foot. The same applies for the second leg 19 which also comprises an upper position 20 and a lower position 23.

The zipper 3 is preferably formed as a lying C curve from its starting position 4 to its end position 5, enabling the user to open and close it in one drag easily with the use of a zipper tab or zipper locker 6. When closed, the zipper folds into a pocket to protect the zipper tab 6. When opened, a portion of the rear side of the mid-portion 8 falls back halfway 10, exposing the back part of the user 12.

The position of the C-shaped zipper serves several purposes: firstly is that it may ensure that the zipper naturally follows a line on the body with minimum interference with the user's body contexture; another one is to ensure unhindered usage of the zipper while wearing a life vest or other garments on the upper body; another is to allow the user to sit down on their back without exposing the zipper to any friction from outside that may degrade its structure. Furthermore, it enables an attachment to the wetsuit, which minimizes stress on the wetsuit's structure, thus reducing the risk of compromising its intended functionality. Finally, the position of the zipper may ensure that the wetsuit's fabric has a slim and tight fit to the body. A wetsuit which hangs loose on the body will lose all its intended functionality.

Furthermore, the zipper is preferably curved to reach its outer position. The start 4 and end 5 positions are positioned at a certain point from the zipper over an arch 9, which allows part of the rear mid-portion to bend down naturally and the user to sit down without stressing the zipper's endpoints or the suit's neoprene.

The zipper is preferably attached to a mounting strip panel 7. The zipper is bonded into the panel inner surface, with a plurality of recesses 14 cut into the zipper fastening fabric 13. The plurality of recesses are arranged at a certain distance from each other to form a curve 15 in the zipper 3 and angled to curve the zipper 3. The recesses 14 are covered with fastening tape, on both sides of the zipper to protect the recesses and fabric. The zipper may advantageously be securely fastened to the panel 7 to improve the connection between the wetsuit and the zipper to form a substantially stress-free connection, and the zipper may additionally maintain its curve without wrinkling or folding which may be important to minimize. The curved shape of the zipper may enable for the wetsuit's fit, structure, and flexibility. While providing functionality to open a part of the rear mid-portion, a miss fit will cause heat loss and water intrusion, which is avoided by the present invention. The mounting strip panel should preferably be broad enough to distribute the stresses in the fabric before connecting it with the wetsuit's other panels.

The inside of the rear mid-portion is partially covered with an inner layer of neoprene 11. This is in conjunction with the zipper's overarch 9 along each leg's side down to the start 4 and end 5 positions of the zipper 3.

The inner layer of neoprene is preferably a relatively thin material provided for waterproofing, heat insulation, protection from rubbing the back part from the zipper when closed, and covering the user's back when the zipper is opened and the rear mid-portion falls back.

The invention claimed is:

1. A wetsuit, comprising an upper body portion, a lower leg portion, and a mid-portion arranged between the upper body portion and the lower leg portion, the lower leg portion comprising a first leg and a second leg, wherein the first leg, the second leg and the mid-portion each comprises a front side and a rear side, wherein the wetsuit comprises a zipper configured to unzip at least a portion of the rear side of the mid-portion, the zipper extending from an upper position of the first leg's front side, over a first hip, across the rear side of the mid-portion, over a second hip, and down to an upper position of the second leg's front side.

2. The wetsuit according to claim 1, wherein the zipper extends in a lying C-shape.

3. The wetsuit according to claim 1, wherein the wetsuit further comprises a strip of neoprene attached to the lower leg portion and to the mid-portion, the zipper being arranged in the strip of neoprene.

4. The wetsuit according to claim 3, wherein the strip of neoprene is at least welded to the lower leg portion and to the mid-portion.

5. The wetsuit according to claim 1, wherein the zipper is attached to a respective inner surface of the upper position of the first leg's front side, the upper position of the second leg's front side, and the rear side of the mid-portion.

6. The wetsuit according to claim 5, wherein the zipper comprises a zipper attachment structure attaching the zipper to the respective inner surfaces of the upper position of the first leg's front side, the upper position of the second leg's front side, and the rear side of the mid-portion.

7. The wetsuit according to claim 6, wherein the zipper attachment structure comprises a plurality of recesses along the extension of the zipper from the upper position of the first leg's front side to the upper position of the second leg's front side.

8. The wetsuit according to claim 1, wherein the wetsuit is made of a neoprene material.

9. The wetsuit according to claim 1, wherein the wetsuit is a one-piece wetsuit.

* * * * *